US005810697A

United States Patent [19]

Joiner

[11] Patent Number: 5,810,697

[45] Date of Patent: Sep. 22, 1998

[54] PUSH CART FOR RESISTANCE EXERCISE

[76] Inventor: Belinda J. Joiner, 3730 N. Camino Blanco Pl., Tucson, Ariz. 85718

[21] Appl. No.: 846,329

[22] Filed: Apr. 30, 1997

[51] Int. Cl.[6] ..... A63B 21/06

[52] U.S. Cl. ..... 482/68; 482/93; 280/47.371; 280/79.6

[58] Field of Search ..... 482/93, 94, 97, 482/104, 66–68, 148, 904; 280/47, 34, 651, 47.35, 47.371, 79.3, DIG. 4, 79.6, DIG. 5; 242/557

[56] References Cited

U.S. PATENT DOCUMENTS

| | | | |
|---|---|---|---|
| 1,729,557 | 11/1929 | Stoll . | |
| 1,930,074 | 10/1933 | Bentley | 242/557 X |
| 2,362,466 | 11/1944 | Carter . | |
| 2,621,707 | 12/1952 | Ames . | |
| 2,792,874 | 5/1957 | Sundberg . | |
| 2,843,180 | 7/1958 | Schwartz . | |
| 2,973,203 | 2/1961 | Taylor | 482/97 |
| 3,532,356 | 10/1970 | Lillibridge . | |
| 3,913,935 | 10/1975 | McGillicuddy | 280/651 X |
| 4,477,074 | 10/1984 | Bushnell | 482/104 X |
| 4,765,644 | 8/1988 | Bell | 280/651 X |
| 4,796,903 | 1/1989 | Proctor et al. . | |
| 4,826,151 | 5/1989 | Nuredin . | |
| 4,867,439 | 9/1989 | Salyer . | |
| 5,267,931 | 12/1993 | Faetini . | |
| 5,294,158 | 3/1994 | Cheng | 280/DIG. 4 |
| 5,328,192 | 7/1994 | Thompson | 280/47.371 X |

*Primary Examiner*—Richard J. Apley
*Assistant Examiner*—John Mulcahy
*Attorney, Agent, or Firm*—Jean M. Barkley

[57] ABSTRACT

An apparatus is provided herein for resistance exercise of the major muscle groups in the legs and gluteal areas. The apparatus is in the form of a four-wheel push cart comprising (a) a vertical frame structure having a front spaced pair of wheels and a back spaced pair of wheels operatively affixed to the frame structure at the lower end thereof, the wheels rollable along a supporting surface; (b) a transverse handlebar affixed to the frame structure at its upper end; and (c) a free-weight holder affixed to the frame structure, preferably in the form of a bar, for installing and removing free weights. In the practice of the invention, following installation of the desired amount of free weight onto the push cart, one would grasp the handlebar and push and pull the cart so that it rolls back and forth across the supporting surface. The push cart offers a simple and effective form of resistance exercise.

18 Claims, 2 Drawing Sheets

PUSH CART FOR RESISTANCE EXERCISE

TECHNICAL FIELD

The present invention relates generally to exercise equipment, and more particularly, to an apparatus that exercises by means of resistance the major muscle groups in the legs and buttocks upon propulsion by the user.

BACKGROUND ART

Building and toning muscle through resistance exercise benefits the physical health and well-being of individuals and cosmetically improves one's physique by shaping and contouring the body. The term "resistance exercise" generally refers to the physical activity of exerting force against such objects as weights or elasticized bands in order to engage a muscle group. The physical benefits from resistance exercise include strengthening the connective tissues and bone structure to decrease the likelihood of injuries in the event of an impact thereto and to improve support of internal organs and tissues, as well as to prohibit or slow the advance of osteoporosis.

There are a variety of commercially-available exercise apparatuses that offer resistance exercise to various muscle groups of the body. For example, there are various apparatuses available that assist in exercising muscles defining the abdominal wall by positioning the body for more effective abdominal "crunches" (see, e.g., U.S. Pat. No. 5,267,931 issued to James G. Faetini). Various apparatuses for exercising the arm, chest, and back muscles are also commercially available, including conventional dumbbell weights for use with a weight bench as well as apparatuses that employ a system of weights and pulleys to achieve the necessary resistance.

With specific regard to the muscle groups in the legs and buttocks, the typical resistance exercise machine comprises a set of weights that the user pushes or pulls to achieve resistance against a specific muscle area. For example, a resistance exercise machine focusing on providing resistance exercise to the quadriceps area commonly comprises a seat in which the user sits while lifting weights with each foot. Another resistance exercise machine for the muscle groups in the legs comprises a seat in which the user sits while pressing with both feet against foot pedals connected to a weight-pulley system. However, commercially-available apparatus that provide resistance exercise to muscle groups in the legs and buttocks are typically either too limited with regard to muscles actually worked (e.g., limited to the quadriceps) or too bulky for convenient use by individuals (e.g., a bench associated with a system of weights and possibly pulleys).

U.S. Pat. No. 4,867,439, issued to Salyer and assigned on its face to The Coach and Company Inc., teaches an apparatus designed to enhance locomotion exercise that comprises a frame supported for rolling motion along the ground by a pair of axled wheels. It is disclosed therein that the user pushes or pulls the frame while walking, jogging, or running to enhance his or her cardiovascular workout by virtue of the added weight propelled. However, this apparatus is a two-wheel structure that requires the user to lift part of the frame while pushing, such that the angle of force applied by the user varies according to the carriage and posture of the user throughout exercise. While having a two-wheel base is likely advantageous for purposes of cardiovascular exercise, one focusing on muscle toning would be better served if the apparatus offered greater predictability and stability in the angle of resistance.

It follows that a need exists for an apparatus for resistance exercise of the major muscle groups in the legs and gluteal area that offers a predictable angle of resistance, operates in a non-jarring manner, and is both effective and convenient to use.

DISCLOSURE OF INVENTION

An apparatus is provided herein for resistance exercise of the major muscle groups in the legs and gluteal areas that overcomes the above-described limitations of existing exercise equipment. Specifically, the apparatus takes the form of a push cart comprising (a) a vertical frame structure having a front spaced pair of wheels and a back spaced pair of wheels operatively affixed to the frame structure at the lower end thereof, the wheels rollable along a supporting surface; (b) a transverse handlebar affixed to the frame structure at its upper end; and (c) a means affixed to the frame structure for installing and removing free weights.

It is contemplated that one using the present apparatus will install the desired amount of free weight onto the push cart and will then proceed to grasp the handlebar with both hands and propel the cart back and forth. In this fashion, one effectively exercises the quadriceps, hamstrings, buttocks, gluteus maximum and calves in a non-jarring fashion. Since the push cart has a solid four-wheel base, it offers a stable and predictable angle of resistance. It is simple in design and therefore requires little if any maintenance and, unlike elaborates pulley/weight systems, is convenient to store between uses.

The foregoing features, advantages, and benefits of the invention, along with additional ones, will be seen in the ensuing description and claims which should be considered in conjunction with the accompanying drawings.

BEST MODES FOR CARRYING OUT THE INVENTION

An apparatus is provided which allows one to effectively resistance exercise the major muscles in the legs and gluteal areas in a simple, non-jarring motion using a convenient push cart design. The push cart preferably has a low profile and comprises (a) a vertical frame structure having a front spaced pair of wheels and a back spaced pair of wheels operatively affixed to the vertical frame structure at the lower end thereof, with the wheels being rollable along a supporting surface; (b) a transverse handle bar affixed to the upper end of the vertical frame structure; and (c) a means affixed to the frame structure for holding free weights and allowing ready installation and de-installation of the free weights from the structure as desired.

Figure 1:
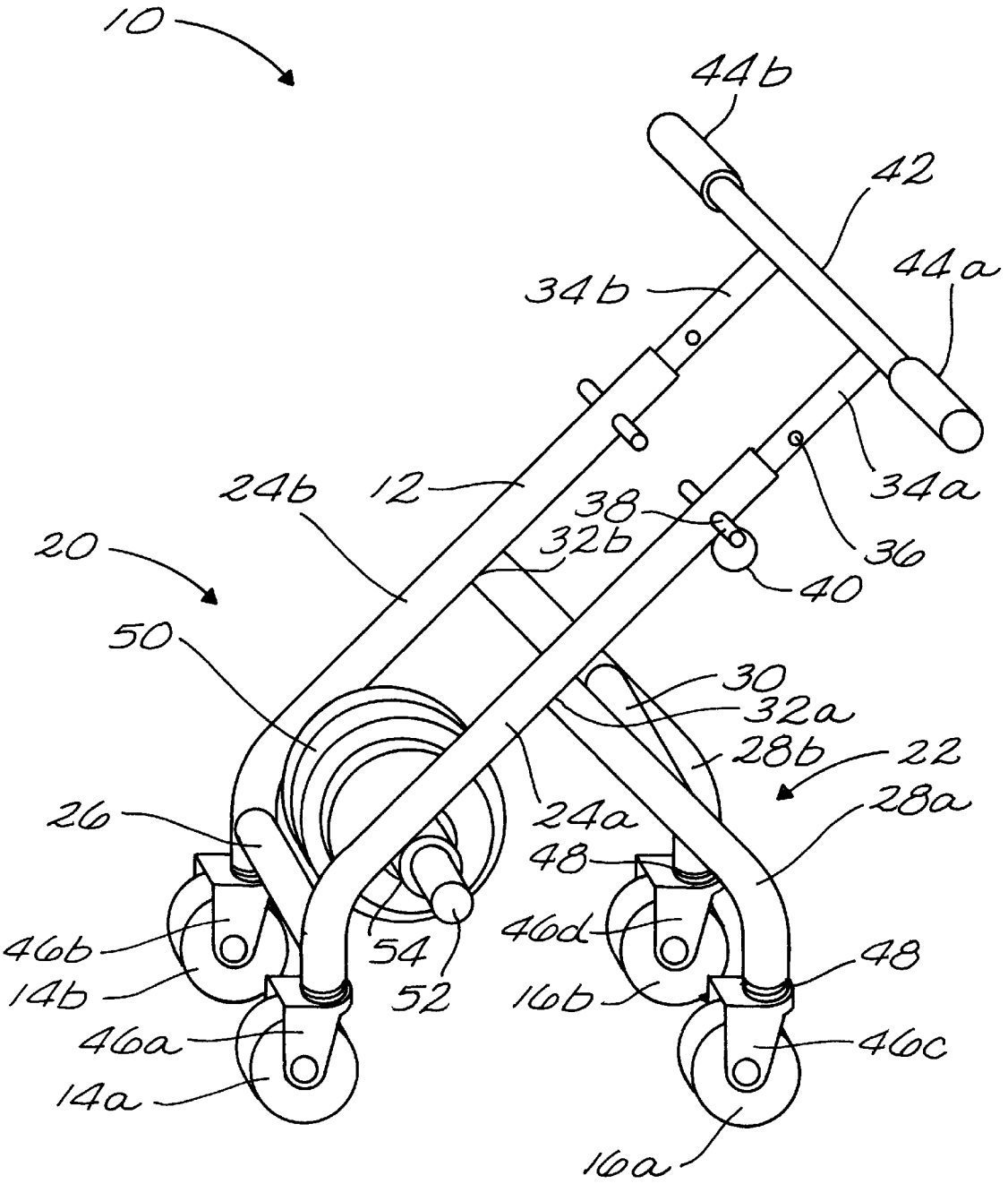
FIG. 1 is a perspective view of a preferred embodiment of the apparatus employed in the practice of the invention.

Turning now to the drawings, in which like numbers represent like parts throughout the several views, the preferred embodiment of the present push cart 10 is depicted in FIG. 1. In general, the push cart 10 will comprise a frame, generally 12, which is supported by a front pair of wheels 14*a,b* and a back pair of wheels 16*a,b* for travel over a supporting surface 18 (shown in FIG. 2), such as the ground or a floor. The frame 12 preferably comprises a front portion, generally 20, and a back portion, generally 22, and preferably comprises metal that is welded together and painted as needed, although the frame 12 may comprise any material having suitable strength and may comprise parts joined in any secure fashion, such as by fasteners, e.g., bolts. Most preferably, the front portion 20 comprises a pair of parallel side members 24*a,b* connected by brace 26, and the back portion 22 comprises a pair of parallel side members 28*a,b* connected by brace 30, although the front and back portions 20 and 22 could conceivably each comprise solid sheets of material or other reasonable configurations. It is contemplated that the parallel side members (24*a,b* and 28*a,b*) and their connecting braces 26,30 will comprise metal tubes, most preferably having an outer diameter of about 1.25 inches and welded together in the nature of a bicycle frame. The braces 26 and 30 may be welded to their respective parallel side members 24*a,b,* and 28*a,b,* or in an alternative embodiment, the braces 26 and 30 could be connected thereto by fasteners (not shown) that would allow the dismantling of the apparatus into two narrow pieces for storage, namely the side members 24*a* and 28*a* as one piece and the side members 24*b* and 28*b* as another piece.

In the preferred embodiment, the top 32*a,b* of the parallel side members 28*a,b* making up the back portion 22 connects to the underside of the parallel side members 24*a,b* making up the front portion 20 at or near the middle thereof. However, the invention is not so limited in configuration, so long as the frame may be stably rolled on its four-wheel base and may hold free weights. For example, the back portion 22 could conceivably connect to the front portion 20 nearer to the top or bottom of the front portion 20, although the configuration depicted in FIG. 1 is believed to be optimally stable.

Figure 2:
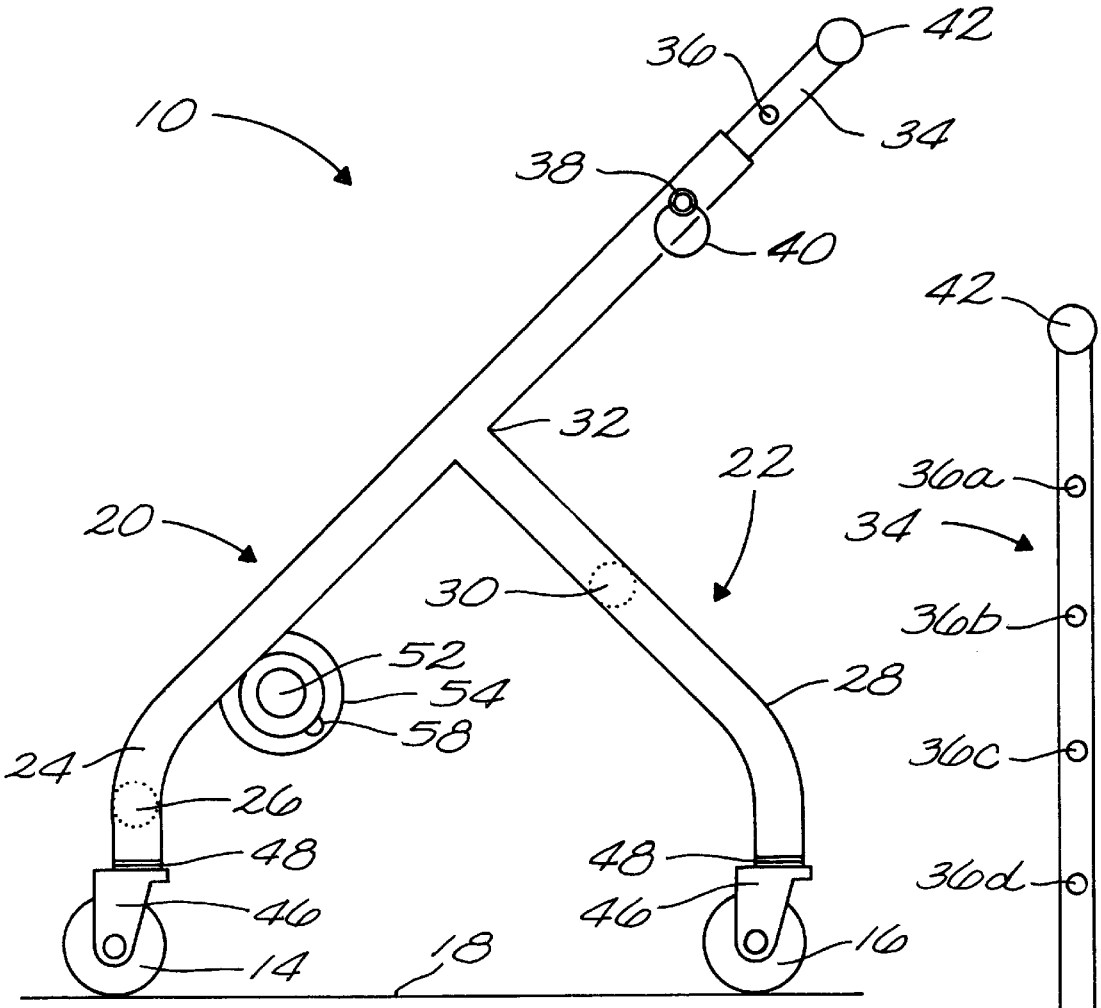
FIG. 2 is side elevational view of the preferred embodiment depicted in FIG. 1.
Figure 3:
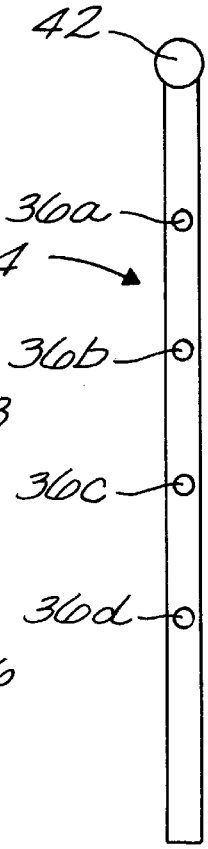
FIG. 3 is a side elevational view of the extension used to adjust the height of the apparatus.

The typical height of the push cart 10 is contemplated to be about twenty-one (21) inches) to achieve optimum resistance exercise for the legs and gluteal area, although the dimensions of the frame structure may be tailored to the particular individual using the apparatus. In particular, it is contemplated that the height of the apparatus 10 may be customized with the use of extensions 34*a,b,* although the height of the apparatus 10 preferably does not exceed about twenty-six (26) inches in the practice of the invention. Specifically, a pair of metal tubes having an outside diameter somewhat less than the inside diameter of the parallel side members 24*a,b* is contemplated, such that the extensions 34*a,b* may be inserted into the parallel side members 24*a,b* as depicted in FIGS. 1 and 2. If the parallel side members 24*a,b* have an outer 1.25-inch and an inner 1.16-inch diameter, the outer diameter of the extensions 34*a,b* is preferably about one (1) inch. The extensions 34*a,b* are contemplated to have openings 36*a,b,c,d* as depicted in FIG. 3, and likewise the front parallel side members 24*a,b* are contemplated to have opening 38 completely through the opposing sidewalls thereof. To select an appropriate length, one would pull the extension 34 out of the side member 24 until the approximate desired length of front portion 20 is reached and would then align the opening 38 in the front parallel side member 24 with an opening (36*a,b,c,* or *d*) in the extension 34. A pin 40 would then be inserted through the openings 38 and 36(*a,b,c,* or *d*) to prevent additional movement by the extension 34 in relation to the side member 24. Preferably, the pin has dimensions of about 0.375 inch × 2 inches.

The handle bar contemplated for use in the practice of the invention is preferably a transverse handlebar 42 with hand grips 44*a,b* fitted onto the ends thereof, as depicted in FIG. 1, although any reasonable grasping means may be employed in the practice of the invention. The hand grips 44*a,b* are preferably a non-slip, substantially thermally non-conductive material, such as rubber- and foam-type materials. In the preferred embodiment, the transverse handlebar 42 has an outer diameter of about one (1) inch and is a metal that is welded onto the frame 12, such as at the top of the extensions 34*a,b* pictured in FIG. 1. The hand grips 44*a,b* preferably have an inside diameter of about 1 inch for a secure fit over the handlebar 42, and the hand grips 44*a,b* are preferably about four (4) inches long.

In practice, the user bends from the waist to grasp the hand grips 44*a,b,* and while standing behind the back portion 22 of the frame 12, pushes and pulls the apparatus 10 back and forth in a smooth motion. For best results, the apparatus is propelled a minimum of six (6) feet in each direction. The wheels 14, 16 employed in the practice of the invention may assume any configuration allowing the user to roll the push cart 10 back and forth across a surface 18 (shown in FIG. 2). Preferably, the wheels 14, 16 are capable of rolling in all directions, such as depicted by the pivoting wheels 14*a,b* and 16*a,b* of FIGS. 1 and 2. Specifically, in the preferred embodiment of FIGS. 1 and 2, the wheels are swivel stem casters 46*a,b,c,* and *d* mounted to the bottom of the frame and allowing travel in all directions, with sockets 48 fitting inside the metal tubes (24*a,b* and 28*a,b*) comprising the frame 12. The casters 46 most preferably have a wheel diameter within the range of about three (3) to four (4) inches and the wheels themselves 14, 16 are made of plastic or rubber-like material.

Figure 4:
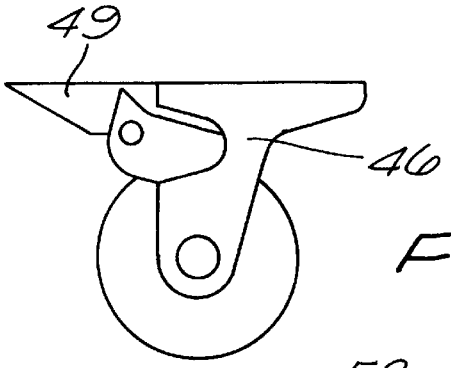
FIG. 4 is a cut away side elevational view of an optional brake feature.

However, the practice of the invention is not limited to any particular type of wheel, so long as the apparatus 10 is stable and the wheels support the weight of the apparatus. In a preferred embodiment, such as depicted in FIG. 1, the distance between the front pair of wheels 14*a,b* and the back pair of wheels 16*a,b* is contemplated to be about fourteen (14) inches, while the width of the apparatus 10 as measured by the distance between the parallel side members 24*a* and 24*b* (or between parallel side members 28*a* and 28*b*) is contemplated to be about nine (9) inches. In an alternate embodiment, the wheels 14*a,b* and 16*a,b* are in the form of swivel stem casters each having foot locks 49, such as illustrated in FIG. 4, thereby allowing the user to lock the wheels 14*a,b* and 16*a,b* in place. It is contemplated the user might utilize the apparatus 10 with locked wheels for its support; for example, one might grasp the handlebar 42 and perform leg lifts.

In a less preferred embodiment, the wheels would only roll forward and backward, with a front pair of wheels being keyed to a first axle shaft (not shown) which would extend transversely between the parallel side members 24*a,b* and a back pair of wheels being keyed to a second axle shaft (not shown) extending transversely between parallel side members 28*a,b*. However, this embodiment would not offer the contemplated degree of flexibility to the user in operating the present apparatus. In other less preferred embodiments, the wheels may be made of material other than plastic or rubber-like materials. For example, spoked wheels and inflated tires, among other options, may be employed in the practice of the invention so long as the type of wheel is capable of supporting the total weight of the push cart 10.

While the weight of the apparatus itself constitutes a certain amount of resistance to the user, the push cart 10 further includes a means of varying the resistance encountered by adding free weights 50 as depicted in FIG. 1. It is contemplated that the free weights 50 added in the practice of the invention are in the form of weighted disks having center holes, such as the free weights used with dumbbells. A series of such conventional free weights, each within the range of about 2.5 to 10 lbs, are contemplated for installation on the present push cart 10. Thus, one may either employ the push cart 10 without free weights, in which case the resistance encountered is the weight of the push cart itself, or one may employ a series of free weights 50, in which case the resistance encountered would be the weight of the push cart 10 plus the weight of the free weights 50 installed thereon. It follows that one may tailor the push cart 10 to represent the desired amount of resistance for exercise.

Figure 5:
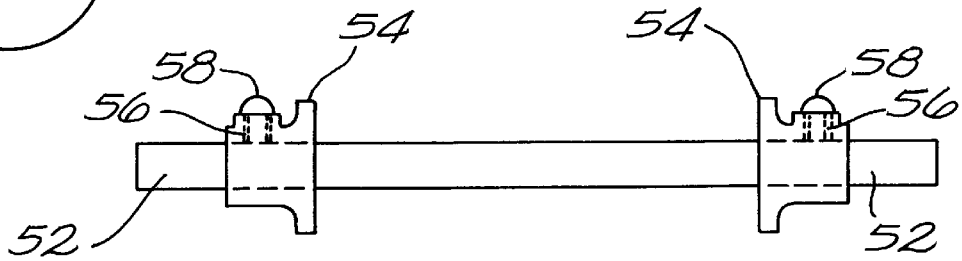
FIG. 5 is a cut away front elevational view of the system used to hold the dumbbell weights as depicted in FIG. 1.

The free weights 50 are preferably supported on a bar 52 that journals through the center holes of the free weights. The bar 52 is contemplated to be a solid metal bar about one (1) inch in diameter and having a length within the range of about ten (10) to sixteen (16) inches. The bar is removable in the preferred embodiment and is retained in position on the push cart 10 by means of collars 54 that are affixed to the front portion 20 of the frame, although the weights might less preferably be placed elsewhere on the frame 12. The collars 54 are preferably metal and are welded to the front portion 20 of the frame; specifically, opposing collars 54 are each welded to a front parallel member 24*a,b*. The collars 54 have an inside diameter that allows the bar 52 to journal therethrough without too much excess space. For example, for a one (1) inch bar 52, the collars 54 preferably have an inside diameter of about 1.0625 inch. Each collar 54 has an opening 56 in its sidewall into which a set screw 58 may be firmly screwed such that the end of the set screw 58 contacts the bar 52 and secures the bar 52 in place, such as depicted in FIG. 5.

In order to remove or install free weights in the preferred embodiment depicted in FIG. 1, one would loosen the set screws 58 in the collars 54, enabling one to pull the bar 52 through the collars 54. In practice, one would loosen the set screws 58 and then pull the bar 52 through one collar 54, thereby enabling one to either remove free weights 50 previously installed on the bar 52 or add new free weights to the bar 52. Once the desired series of free weights 50 is in place, the free end of the bar 52 would again be journaled through the collar 54 and the set screws 58 of the opposing collars again tightened to secure the bar 52.

Thus, there has been disclosed an apparatus for resistance exercise of the major muscle groups in one's legs and gluteal areas, the apparatus being a stable, four-wheel, low-profile push cart capable of holding a series of free weights. It will be readily apparent to those skilled in the art that various changes and modifications of an obvious nature may be made without departing from the spirit of the invention, and all such changes and modifications are considered to fall within the scope of the invention as defined by the appended claims.

What is claimed is:

1. A push cart for resistance exercise, comprising:

(a) a vertical frame structure having a front spaced pair of wheels and a back spaced pair of wheels operatively affixed thereto at the lower end thereof, said wheels rollable along a supporting surface, said vertical frame structure being wholly supported on said wheels;

(b) a transverse handle bar affixed to said frame structure at the upper end thereof; and (c) free weights (d) a means affixed to said frame structure for securing said free weights such that said free weights are aligned along a single axis, said means allowing ready installation and removal of said free weights therefrom, said means comprising a pair of collars opposingly affixed to said frame structure, a bar adapted to journal through said collars, and a means for securing said bar inside said collars, wherein said opposing collars support said bar at each end thereof.

2. The push cart of claim 1 wherein said vertical frame structure comprises an angularly disposed front portion to which said front spaced pair of wheels are affixed and an angularly disposed back portion to which said back spaced pair of wheels are affixed, the top of said back portion being affixed to the underside of said front portion.

3. The push cart of claim 2 wherein said front portion comprises a first pair of spaced side members and said back portion comprises a second pair of spaced side members, said first pair of spaced side members connected by a first brace and said second pair of spaced side members connected by a second brace.

4. The push cart of claim 3 wherein said front portion further comprises a pair of extensions, each extension associated with a spaced side member of said first pair, each said extension inserted in its associated spaced side member and capable of being extended therefrom to lengthen said front portion, said extensions secured in an extended position by securing means.

5. The push cart of claim 4 wherein each said extension has first opposing openings in a sidewall and wherein each said spaced side member of said first pair has second opposing openings in a sidewall, and wherein said first opposing openings and said second opposing openings are aligned, said securing means comprising a pin inserted through said aligned openings to thereby prevent movement of said extension.

6. The push cart of claim 1 wherein said front spaced wheels are maintained in parallelism with said back spaced wheels.

7. The push cart of claim 1 wherein said front spaced wheels and said back spaced wheels are pivotally affixed to said lower end of said vertical frame structure by means of casters.

8. The push cart of claim 7 wherein said casters include a means for locking said front spaced wheels and said back spaced wheels.

9. The push cart of claim 1 wherein said transverse handle bar has hand gripping portions at each end thereof.

10. The push cart of claim 1 wherein said means for securing said bar inside said collars comprises a pin and a sidewall opening in each said collar for receiving said pin, such that said pin may be inserted through said sidewall opening to press against said bar, thereby securing said bar inside said collar.

11. The push cart of claim 1 wherein said push cart has a height not exceeding about twenty-six (26) inches.

12. A push cart for resistance exercise, comprising:

(a) a vertical frame structure comprising an angularly disposed front portion to which a front spaced pair of wheels are pivotally affixed at the bottom thereof and an angularly disposed back portion to which said back spaced pair of wheels are pivotally affixed at the bottom thereof, said wheels rollable along a supporting surface and maintained in parallelism;

(b) a transverse handle bar affixed to the upper end of said front portion, said transverse handle bar having hand gripping portions at each end thereof;

(c) free weights comprising disks having centered holes; and (d) a means for holding said free weights comprising a pair of opposing collars affixed to said front portion of said frame structure, a bar adapted to journal through said opposing collars and through said centered holes of said free weights, and a means for securing said bar inside said opposing collars, said opposing collars supporting said bar at each end thereof and surrounding said disks along said bar.

13. The push cart of claim 12 wherein said front portion comprises a first pair of spaced side members and said back portion comprises a second pair of spaced side members, said first pair of spaced side members connected by a first brace and said second pair of spaced side members connected by a second brace.

14. The push cart of claim 13 wherein said front portion further comprises a pair of extensions, each said extension associated with a spaced side member of said first pair, each said extension inserted in its associated spaced side member and capable of being extended therefrom to lengthen said front portion, said extensions secured in an extended position by securing means.

15. The push cart of claim 14 wherein each said extension has first opposing openings in its sidewall and wherein each said spaced side member of said first pair has second opposing openings in its sidewall, and wherein said first opposing openings and said second opposing openings are aligned, said securing means comprising a pin inserted through said aligned openings and thereby preventing movement of said extension.

16. The push cart of claim 12 wherein said means for securing said bar inside said collars comprises a pin and a sidewall opening in each said collar for receiving said pin, such that said pin may be inserted through said sidewall opening to press against said bar, thereby securing said bar inside said collar.

17. The push cart of claim 12 wherein said push cart has a height not exceeding about twenty-six (26) inches.

18. A push cart for resistance exercise, comprising:

(a) a vertical frame structure comprising a front portion comprising an angularly disposed first pair of spaced side members and a back portion comprising an angularly disposed second pair of spaced side members, said first pair of spaced side members connected by a first brace and said second pair of spaced side members connected by a second brace, the top of said back portion being affixed to the underside of said front portion, each said spaced side member having a wheel pivotally affixed at the bottom thereof, said wheels being rollable along a supporting surface, maintained in parallelism and capable of being locked;

(b) a pair of extensions for lengthening said front portion, each said extension associated with a spaced side member of said first pair of spaced side members, each said extension inserted in its associated spaced side member and capable of being extended therefrom to lengthen said front portion, said extensions secured in an extended position by a pin inserted through opposing aligned openings in sidewalls of said extension and said associated spaced side member;

(c) a transverse handle bar affixed to the upper end of said front portion, said transverse handle bar having hand gripping portions at each end thereof;

(d) free weights comprising disks having centered holes; and (e) a means for holding said free weights comprising (i) a pair of collars opposingly affixed to said first pair of spaced side members, (ii) a bar adapted to journal through said opposing collars and through said centered holes of said disks, said opposing collars supporting said bar at each end thereof and surrounding said disks along said bar, and (iii) a means for securing said bar to said opposing collars comprising a pin and a sidewall opening in each said collar for receiving said pin, such that said pin may be inserted through said sidewall opening to press against said bar, thereby securing said bar to said collar.

* * * * *